US009687411B2

(12) United States Patent
Chen

(10) Patent No.: US 9,687,411 B2
(45) Date of Patent: Jun. 27, 2017

(54) WALKERS AND METHODS OF USE

(71) Applicant: Bdark Holdings Ltd., Edmonton (CA)

(72) Inventor: Zhi Cheng Chen, Foshan (CN)

( * ) Notice: Subject to any disclaimer, the term of this patent is extended or adjusted under 35 U.S.C. 154(b) by 0 days.

(21) Appl. No.: 15/201,155

(22) Filed: Jul. 1, 2016

(65) Prior Publication Data

US 2016/0310346 A1 Oct. 27, 2016

Related U.S. Application Data

(63) Continuation of application No. 14/139,682, filed on Dec. 23, 2013, now Pat. No. 9,381,132.

(51) Int. Cl.
*A61H 3/04* (2006.01)
*A61H 3/00* (2006.01)

(52) U.S. Cl.
CPC ..... *A61H 3/04* (2013.01); *A61H 3/00* (2013.01); *A61H 2003/002* (2013.01); *A61H 2003/004* (2013.01); *A61H 2003/005* (2013.01); *A61H 2003/046* (2013.01); *A61H 2201/0161* (2013.01); *A61H 2201/1633* (2013.01)

(58) Field of Classification Search
CPC .... A61H 3/00; A61H 3/04; A61H 2201/1633; A61H 2201/0161; A61H 2201/0192; A61H 2003/006; A61G 5/00; A61G 5/08; A61G 2005/0816; A61G 2005/0841; A61G 2005/02; B62B 2205/02; B62B 2205/06; B62B 2301/20
IPC ..... A60H 3/00,3/04
See application file for complete search history.

(56) References Cited

U.S. PATENT DOCUMENTS 7,306,246 B2 * 12/2007 Gale ..... A61H 3/04 280/47.34
2004/0111830 A1 * 6/2004 Cooper ..... B60B 33/045 16/44
2010/0083994 A1 * 4/2010 Liu ..... A61H 3/04 135/67

* cited by examiner

*Primary Examiner* — Bryan Evans
(74) *Attorney, Agent, or Firm* — Christensen O'Connor Johnson Kindness PLLC

(57) ABSTRACT

A walker having a folded position and an unfolded position, wherein the walker comprises a structural frame with a first upright portion, a second upright portion, a folding mechanism between the first upright portion and the second upright portion, ground engaging elements on each of the first upright portion and second upright portion, and a foldable basket with first and second opposed ends secured by one or more fasteners to the first upright portion and the second upright portion, respectively. In another embodiment, walker comprises a structural frame with a first end, a second end, and sides between the first end and the second end, a handle or handles on the structural frame at the first end of the structural frame, ground engaging elements at the first end and the second end of the structural frame, and a suspension system integrated with the structural frame.

24 Claims, 7 Drawing Sheets

WALKERS AND METHODS OF USE

TECHNICAL FIELD

This document relates to walkers and methods of use.

BACKGROUND

Walkers, some versions of which are known as rollators, are used to assist the elderly, the injured, and the infirm in walking from place to place. U.S. Pat. No. 8,083,239 depicts a walker with a removable foldable basket and a rigid body between the wheels and the handles.

SUMMARY

In at least one embodiment, described herein is a walker having a folded position and an unfolded position, the walker comprising a structural frame with a first upright portion, a second upright portion, a folding mechanism between the first upright portion and the second upright portion, and ground engaging elements on each of the first upright portion and second upright portion; and a foldable basket with first and second opposed ends secured by one or more fasteners to the first upright portion and the second upright portion, respectively.

In another embodiment, described herein is a walker comprising a structural frame with a first end, a second end, and sides between the first end and the second end; a handle or handles on the structural frame at the first end of the structural frame; ground engaging elements at the first end and the second end of the structural frame; and a suspension system integrated with the structural frame.

Methods of using the disclosed walkers are also disclosed herein. For example, a method of folding and unfolding the walker is disclosed.

In various embodiments, there may be included any one or more of the following features: The one or more fasteners are tool operated fasteners. The one or more fasteners include rivets. The one or more fasteners include one or more of rivets, bonds, threaded fasteners, nails, push fasteners, adhesive, straps, crimps, tape, stitches, staples, and rod and split pin combinations. The first and second opposed ends comprise plates. A suspension system integrated with the first upright portion and second upright portion. The first upright portion and the second upright portion fold towards and away from each other and define respective sides of the walker extending between a first end of the walker and a second end of the walker, and further comprising a handle or handles on the first upright portion and the second upright portion at the first end of the walker. The folding mechanism comprises a pair of scissor beams, each scissor beam having an intermediate pivot region separating a first span and a second span, with the first span pivotally connected to one of the first upright portion or second upright portion, and the second span pivotally connected to the other of the first upright portion or second upright portion through a lever arm, in which each second span comprises a lock for engaging the respective lever arm to lock the walker in an unfolded position. Each lock comprises a latch pivotally connected to the respective second span and having a slot positioned to engage a corresponding pin on the respective lever arm in the unfolded position. Each pin defines a first travel path between a folded and an unfolded position, and in which each latch defines a second travel path that intersects the respective first travel path, each latch being biased into a closed position and having an outer profile shaped at a pin contact point on the second travel path to allow the pin to open the latch and enter the slot. A handle connected to open both latches when under one or more of tension or compression. The ground engaging elements comprise wheels. A seat at the first end of the structural frame. The ground engaging elements at the first end comprise one or more lever arms pivotally connected to the structural frame, with struts, of the suspension system, extended between the one or more lever arms and the structural frame. The structural frame comprises first and second upright portions that each define a respective side of the structural frame, extend to a respective handle, and are connected to a respective strut, and in which the structural frame further comprises a folding mechanism between the first and second upright portions to allow the first and second upright portions to fold towards and away from each other. The first and second upright portions each have a respective fork that mounts a respective ground engaging element at the second end, has a first branch extended to a respective handle, and has a second branch pivotally connecting a respective lever arm. Each strut is adjustable in stiffness.

These and other aspects of the device and method are set out in the claims, which are incorporated here by reference.

BRIEF DESCRIPTION OF THE FIGURES

Embodiments will now be described with reference to the figures, in which like reference characters denote like elements, by way of example, and in which.

DETAILED DESCRIPTION

Figure 1:
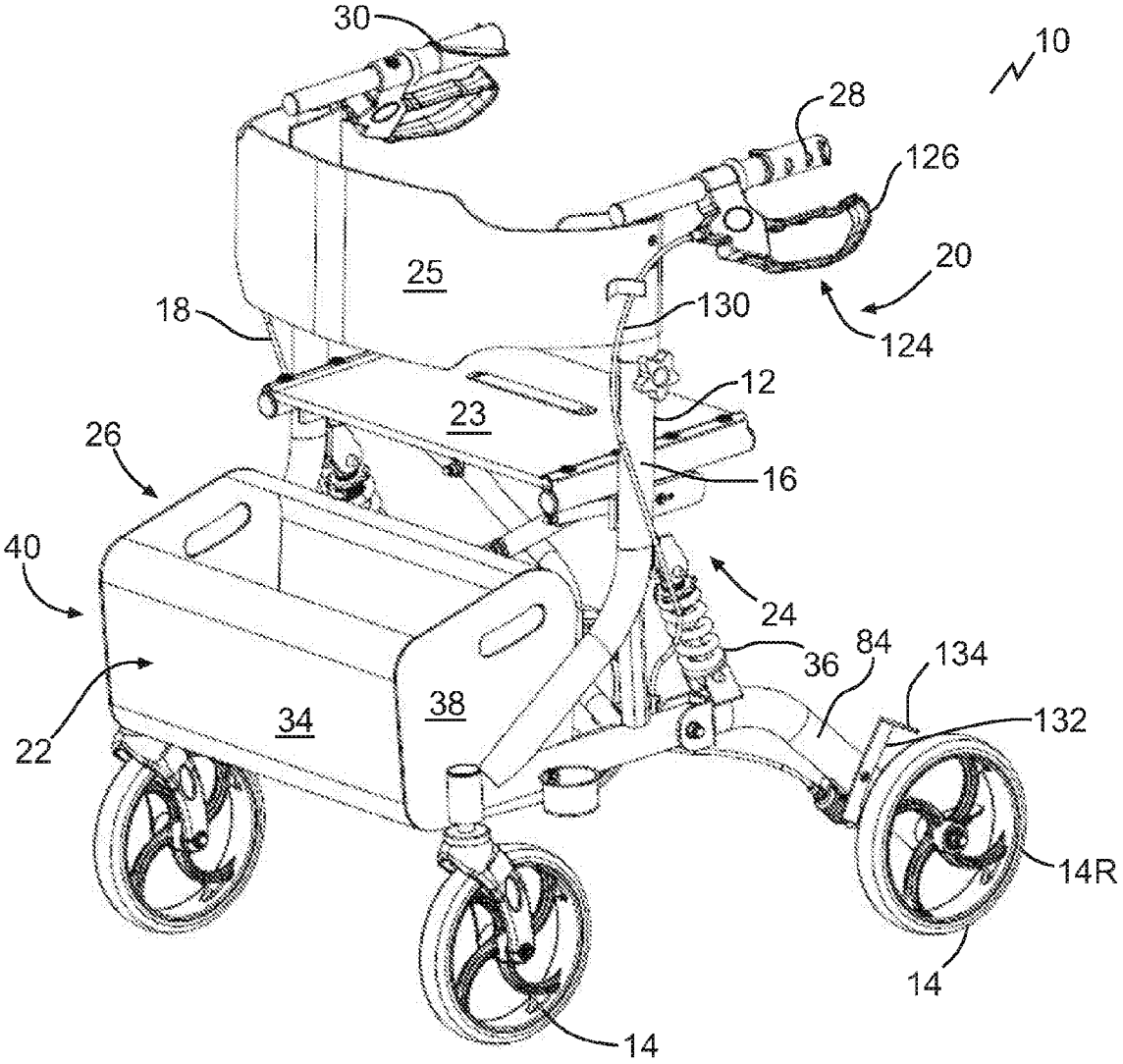
FIGS. 1-3 are front perspective, side elevation, and rear perspective views, respectively, of a walker.

Immaterial modifications may be made to the embodiments described here without departing from what is covered by the claims.

A walker or walking frame is a tool for disabled or elderly people who need additional support to maintain balance or stability while walking. The British English common equivalent term for a walker is Zimmer frame. A walker is also a tool for those who are recuperating from leg or back injuries. It is also commonly used by persons having problems with walking or with mild balance problems.

Walkers started appearing in the early 1950s, though walkers for babies have existed at least since the fifteenth century. The first US patent was awarded in 1953 to William Cribbes Robb, of Stretford, England, for a device called "walking aid," see U.S. Pat. No. 2,656,874. Two variants with wheels were both awarded U.S. Patents in May 1957, namely U.S. Pat. Nos. 2,792,052 and 2,792,874. The first non-wheeled design that was called a "walker" was patented in 1965 by Elmer F. Ries of Cincinnati, Ohio, see U.S. Pat. No. 3,165,112. The first walker to resemble modern walkers was patented in 1970 by Alfred A. Smith of Van Nuys, Calif., see U.S. Pat. No. 3,517,677. The first walker cane hybrid was developed by Dannie H. King, Ph.D. of Carlsbad, Calif. in 2009, see U.S. Pat. No. 8,291,924.

The basic walker design has a frame that is about waist high. Walkers are also available in other sizes such as pediatric (for children) or bariatric (for obese persons). Modern walkers are height adjustable and may be set at a height that is comfortable for the user, but will allow the user to maintain a slight bend in their arms. This bend allows for proper blood circulation through the arms as the walker is used. The front two legs of the walker may or may not have wheels attached, depending on the strength and abilities of the person using it. It is also common to see caster wheels or glides on the back legs of a walker with wheels on the front.

The person walks with the frame surrounding their front and sides and their hands provide additional support by holding on to the top of the sides of the frame. Traditionally, a walker is picked up and placed a short distance ahead of the user. The user then walks to it and repeats the process. With the use of wheels and glides, the user may push the walker ahead as opposed to picking it up. This makes for easier use of the walker, as it does not require the user to use their arms to lift the walker. This is beneficial for those with little arm strength. Wheels may prevent safety issues, and brakes have been added to such wheels to address such issues.

Also related is a hemi-walker, a walker about half the size of a traditional walker which is intended for use by persons whose dexterity is limited or non-existent in one hand or arm. These walkers are more stable than a quad cane (a cane with four points that touch the ground, as opposed to one), but are not recommended as highly as a traditional walker for those who can use it.

Another type of walker is the rollator, also called a wheeled walker. Although originally a brand name, "rollator" has become a genericized trademark for wheeled walkers in many countries, and is also the most common type of walker in several European countries. The rollator may have a frame with three or four large wheels, handlebars, and a built-in seat, which allows the user to stop and rest when needed. Rollators are also often equipped with a shopping basket. Rollators are typically more sophisticated than conventional walkers with wheels. They are adjustable in height and are light-weight, yet sturdier than conventional walkers. The handlebars are equipped with hand brakes that can be lifted or pushed downward to instantly stop the rollator. The brakes can also be used in maneuvering the rollator; by braking one side while turning the rollator towards that side a much tighter turning radius can be achieved.

Walkers also exist that provide support and stability to dogs, while allowing them to rely partly on their hind legs. They are suitable for dogs with mobility or stability problems with hind legs. They also help them to exercise their back legs and can help maintain any partial mobility the dogs may have left or, in some cases, help to improve it.

Figure 2:
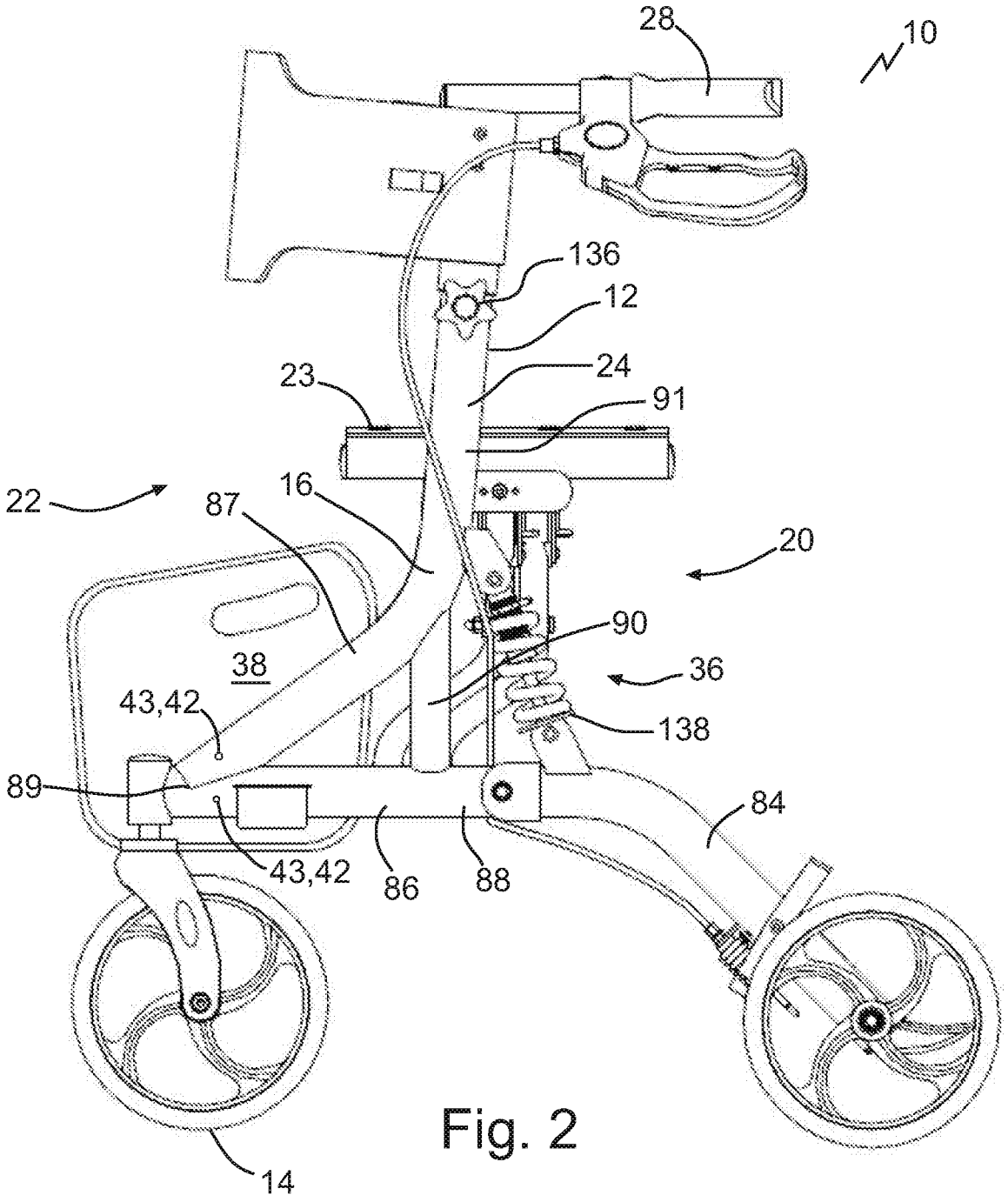
Figure 9:
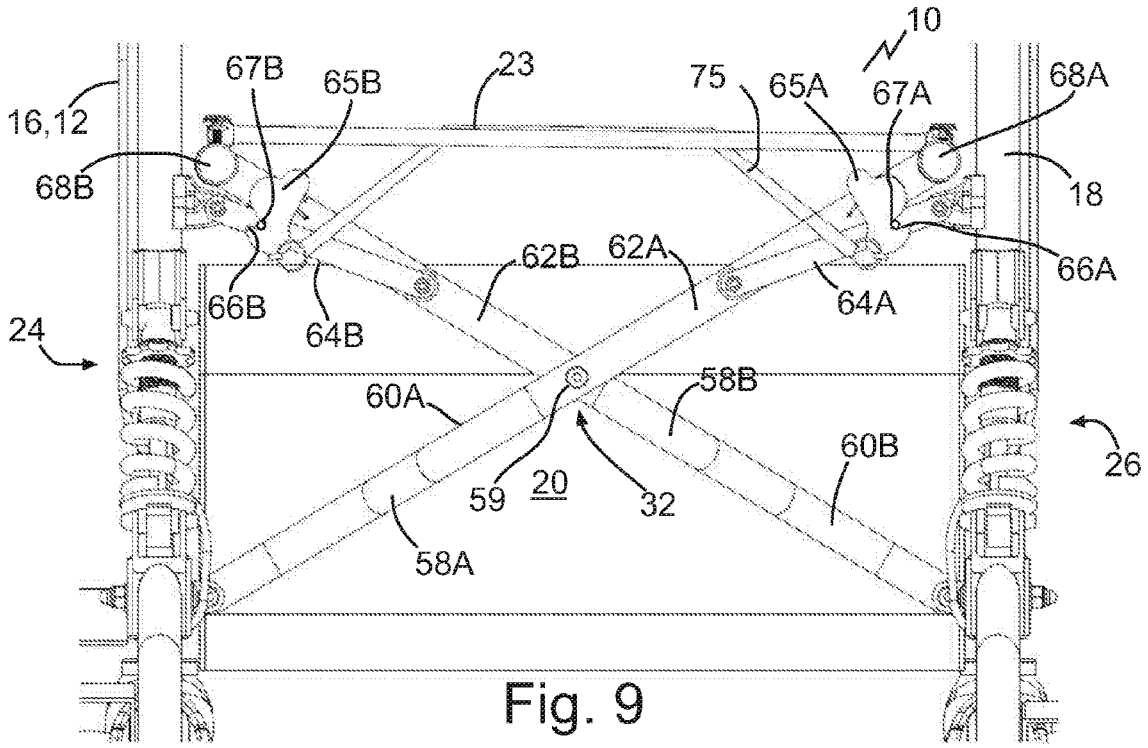
FIGS. 9-11 are rear elevation views of the folding mechanism of the walker of FIGS. 1-3 shown in an unfolded position, an intermediate folded position, and a folded position, respectively.

Referring to FIGS. 1-3, 9, and 11, a walker 10 is illustrated having a structural frame 12 and ground engaging elements 14. Structural frame 12 may have a first upright portion 16 and a second upright portion 18 (FIG. 1). Structural frame 12 may have a first end 20, a second end 22, and sides 24, 26 between the first end 20 and the second end 24 (FIGS. 1, 2, and 9). Upright portions 16 and 18 define sides 24, 26, respectively, of the structural frame 12 (FIG. 9). Ground engaging elements 14 are located at each of the first and second ends 20, 22, for example on each of the first upright portion 16 and second upright portion 18 (FIG. 1). A handle or handles 28, 30 may be on the structural frame 12, for example, on each of portions 16 and 18, at the first end 20 of the structural frame 12. A folding mechanism 32 may be provided between the first upright portion 16 and the second upright portion 18 for moving the walker 10 between a folded position (FIG. 11), and an unfolded position (FIG. 9). A foldable basket 34 may be present (FIG. 1). A suspension system 36 may be integrated with the structural frame 12 (FIG. 1). A seat 23, for example with a backrest 25, may be provided at the first end 20 of the structural frame 12.

Figure 4:
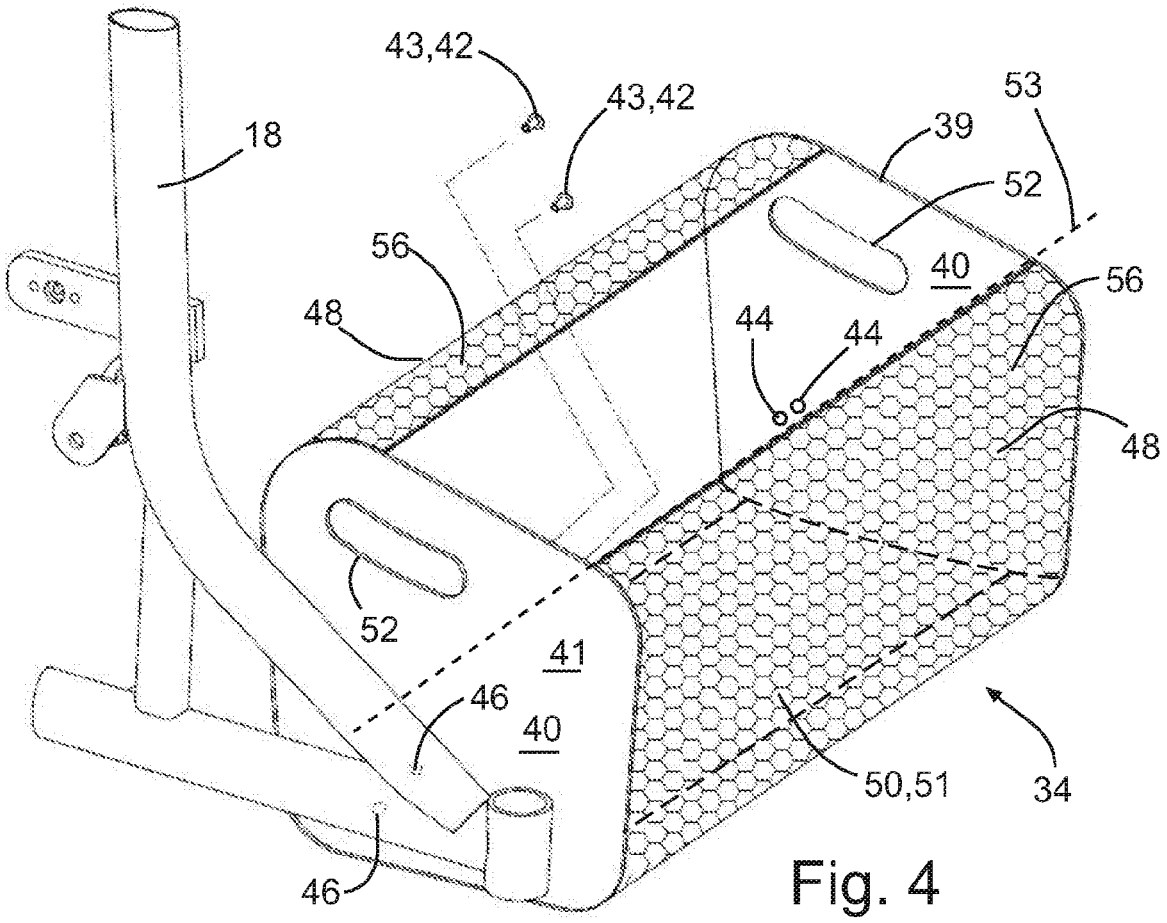
FIGS. 4 and 5 are front perspective and side elevation views, respectively, of a foldable basket from the walker of FIGS. 1-3.

Referring to FIGS. 1, 2, 4, and 5, a foldable basket 34 is illustrated. Basket 34 may have first and second opposed ends 38, 40. Ends 38 and 40 may comprise plates 39 and 41, respectively. Ends 38 and 40 may be secured by one or more fasteners 42 to upright portions 16 and 18, respectively (FIGS. 1, 2, and 4). Two or more fasteners 42 may be used to secure each end 38 and 40, to prevent tipping of basket 34 in use. Fasteners 42 may include rivets 43, which, for example, pass through respective sets of holes 44, in plates 39 and 41, and aligned holes 46 in upright portions 16 and 18 (FIG. 4).

The fasteners 42 are intended to secure basket 34 to frame 12 in a fashion that prevents the basket 34 from being removed by the user. Hence, fasteners 42 may secure basket 34 to the frame 12 by varying degrees of permanence, from (a) a degree where it is inconvenient to manually disassemble the fastener, for example in the case of a wingnut and bolt combination, to (b) a degree where tools are required to disassemble the fastener, for example in the case of a screw or other tool operated fastener, to (c) a degree where disassembly of the fastener cannot be carried out without damaging the walker 10, which includes the fastener 42 itself, for example in the case of rivets 43. Other examples of fasteners with type (c) permanence include welds, bonds, stitches, staples, and adhesive. Other fasteners 42 may be used, for example threaded fasteners, nails, push fasteners, straps, tape, and rod and split pin combinations. Bonds include welds, soldering, and brazing. Adhesive includes cementing and gluing. Threaded fasteners include screws, bolts and nuts. Push fasteners include friction plugs such as Christmas tree fasteners. Rod and split pin combinations include cotter pins, and bowtie pins. Straps include tie wraps, bands, and wires. Other fasteners may be used, and each category and sub category of fasteners may include difference fasteners not mentioned here.

Figure 5:
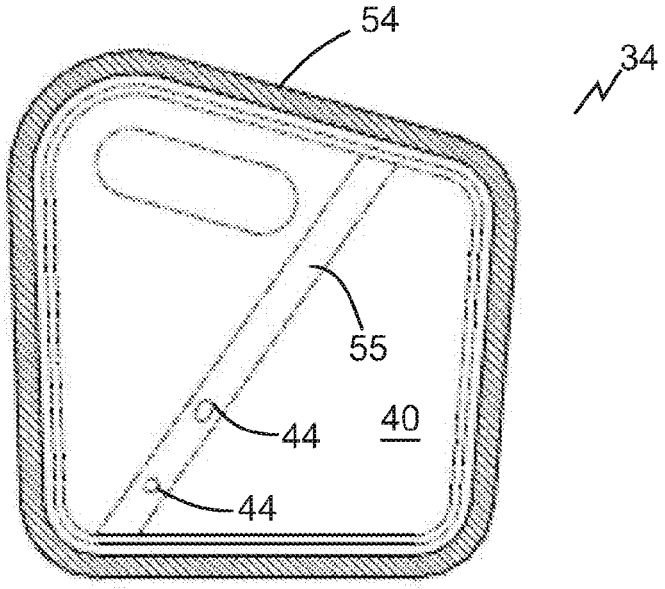

Plates 39 and 41 provide structural anchors across which to span basket sides 48 and a basket bottom 50 (FIG. 4). Other suitable structural anchors may be used for ends 38 and 40, including wire frames or structural webs. For example, ends 38 and 40 may each comprise a structural peripheral loop 54 with a structural arm 55 extended across the loop 54 (FIG. 5). In the example, shown holes 44 pass through arm 55. Flexible material such as cloth may be used to construct at least part of sides 48 and bottom 50, for example, webbed fabric as shown to provide a foldable structure between plates 39 and 41 (FIG. 4). Ends 38 and 40 may also incorporate fabric, for example stretched across loop 54 (FIG. 5). Bottom 50 may include a flexible nonporous platform 51 to prevent small objects from falling out of the bottom 50 (FIG. 4). One or more handles, such as handle holes 52, may be provided in basket 34 to permit grasping by a user's hands, for example to facilitate folding of walker 10 as discussed further below. Basket 34 may have one or more fold lines (not shown), for example, perpendicular to a folding axis 53, between ends 38 and 40 to facilitate folding according to a predetermined pattern, like an accordion. A top cover or partial top cover in the form of one or more top ledges 56 may be provided over the basket 34.

Figure 10:
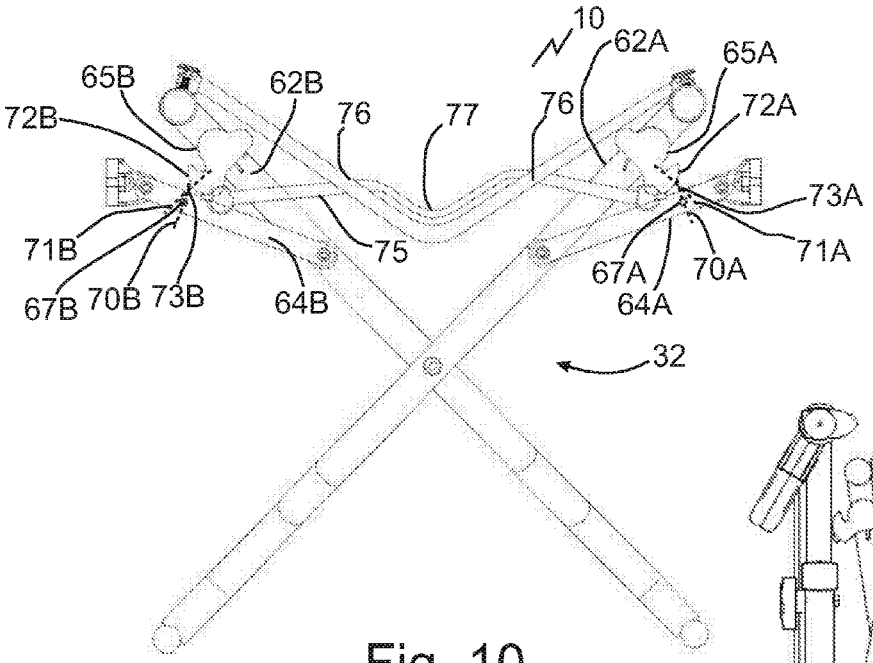
Figure 11:
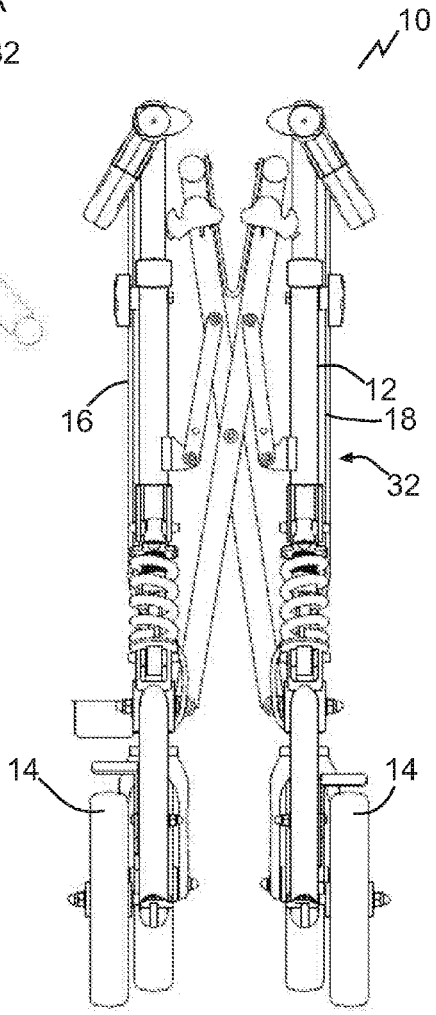

Referring to FIGS. 9-11, as mentioned above, a folding mechanism 32 may be provided. A method of folding the walker 10 with mechanism 32 is also illustrated in FIGS. 9-11. In the example shown the walker 10 is a side folding walker. Thus, mechanism 32 may permit first upright portion 16 and the second upright portion 18 to fold towards (sequence shown from FIG. 9 to FIG. 11) and away (sequence shown from FIG. 11 to FIG. 9) from each other.

Figure 8:
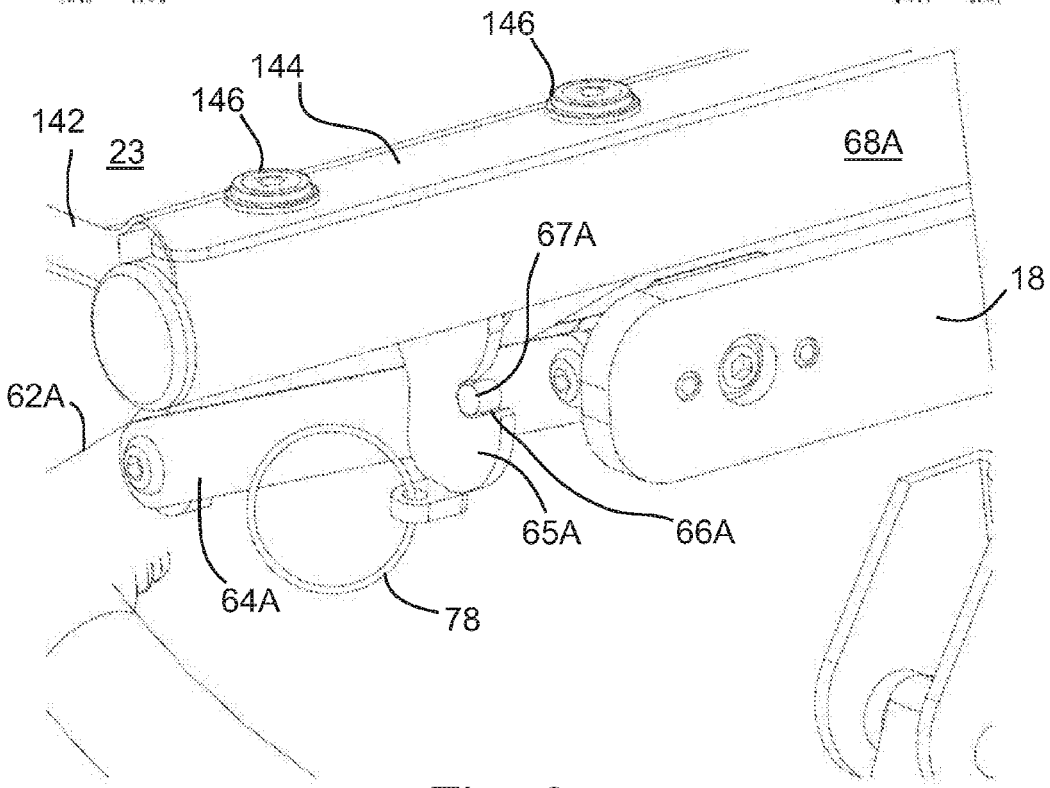
FIG. 8 is a blow up view of the view area marked by 8-8 in FIG. 3.

Folding mechanism 32 may comprise a pair of scissor beams 58 (FIG. 9). Each scissor beam 58 may have an intermediate pivot region, such as a pivot point 59, separating a first span 60 and a second span 62. The suffixes of "A" and "B" are appended to reference numeral 58 and associated parts of folding mechanism 34 in the drawings and places in this description to distinguish between the respective parts and associated components of the two scissor beams 58 and associated parts of the folding mechanism 34. In the example shown pivot point 59 is also defined as the location where beams 58 pivotally connect to one another. However, in other cases the beams 58 may merely cross over one another, with or without contact, in use when viewed along a pivot axis 59 of one or more of beams 58. Each first span 60 may be pivotally connected to one of the first upright portion 16 or second upright portion 18, for example through a respective lever arm (not shown), and each second span may be pivotally connected to the other of the first upright portion 16 or second upright portion 18 through a respective lever arm 64. As shown, spans 60A and 60B are connected to upright portion 16 and 18, respectively, and spans 62A and 62B are connected, through lever arms 64A and 64B, to upright portions 18 and 16, respectively. Second spans 62B may each connect to a respective arm 68 that mounts seat 23, which is shown as being defined by one or more sheets 142 of flexible material (FIGS. 8-9). Sheet 142 or sheets may at least partially wrap over top of arms 68, with a rod 144 in between sheet 142 and arm 68 (FIG. 8). Bolts 146 may pass through sheet 142, rod 144, and arm 68 to secure seat 23 in place.

Referring to FIGS. 8-10, each second span 62 may comprise a lock, such as a latch 65, for engaging the respective lever arm 64 to lock the walker 10 in the unfolded position shown. Latch 65 may be pivotally connected to the respective second span 62. Latch 65 may have a slot 66 positioned to engage a corresponding pin 67 on the respective lever arm 64 in the unfolded position (FIGS. 8-9). Each pin 67 may define a first travel path 70 between a folded and an unfolded position, and each latch 65 may define a second travel path 71 that intersects the respective first travel path 70 (FIG. 10). Each latch 65 may be biased into a closed position, for example biased to rotate clockwise or counterclockwise in the case of latches 65B and 65A, respectively. Each latch 65 may have an outer profile shaped, for example to have a wedge portion 72, at a pin contact point 73 on the second travel path 71 to allow the pin 67 to open the latch 65 and enter the slot 66 when moving into the unfolded position. Thus, in the example shown, in moving from the intermediate folded position (FIG. 10) to folded (FIG. 9), and considering lever arm attachment points 74 to be vertically stationary for description of relative movements of other parts only, pins 67 travel up, latches 65 travel down, and pins 67 contact wedge portion 72, biasing latch 65 to open and pins 67 to enter slot 66 once pins 67 clear wedge portion 72.

One of more handles such as a strap 75 may be connected to open one or both latches 65 when under one or more of tension or compression. Thus, in the example shown, strap 75 connects to both latches 65 to permit a user to pull on strap 75 to apply force on each latch in a direction opposite the biasing closing force of the latch 65, to unlock both latches 65 and initiate folding (FIGS. 9-10). Strap 75 may connect to latches 65 underneath seat 23, and pass through holes 76 in seat 23 to provide a handle portion 77 above seat 23 for ease of access (FIG. 10). Each latch 65 may also include a ring 78 or other hand grip element for direct manipulation of latch 65 (FIG. 8).

Figure 6:
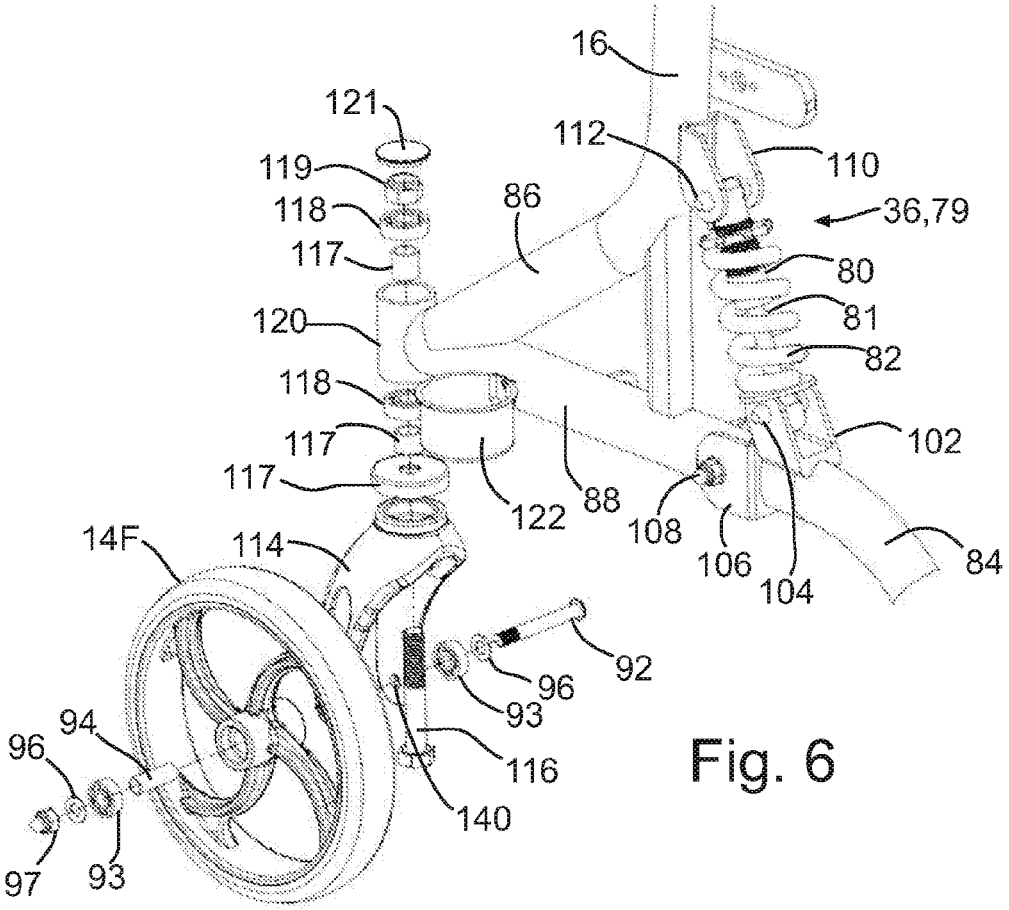
FIGS. 6 and 7 are exploded perspective views of the front and rear wheel assemblies, respectively, of the walker of FIGS. 1-3.
Figure 7:
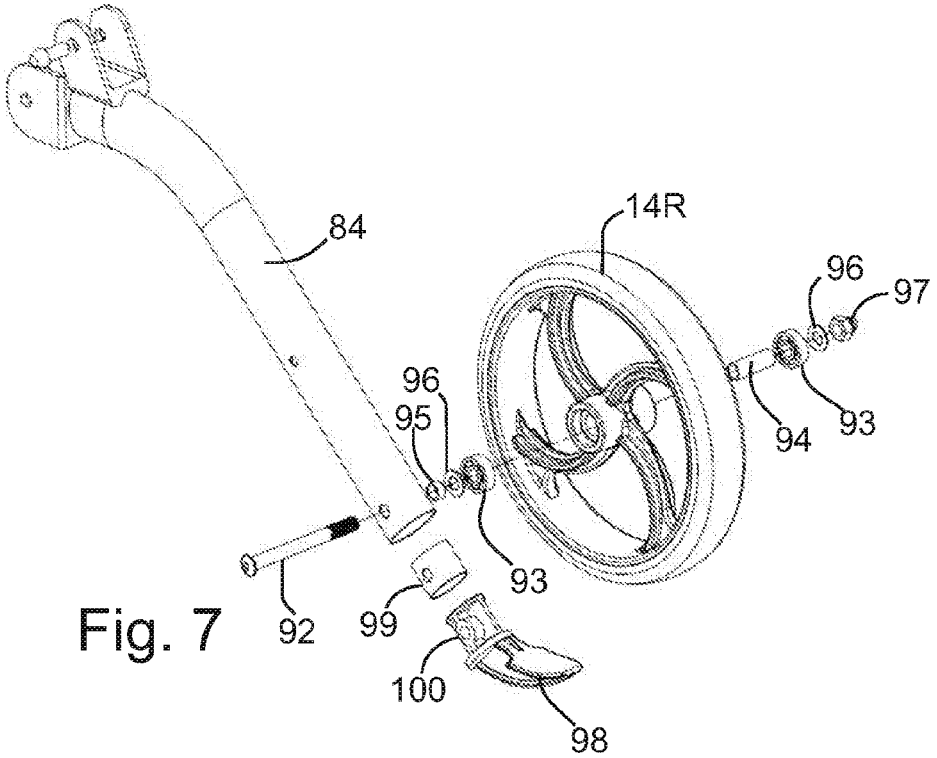

Referring to FIGS. 2, 3, 6, and 7, a suspension system 36 may be integrated with the first upright portion 16 and second upright portion 18. System 36 may include two or more struts 79 (FIG. 3), for example, each having a cylinder 80, a piston 81 telescopically mounted within the cylinder 80, and coil spring 82 connected between the piston 81 and cylinder 80 (FIG. 6). The ground engaging elements 14 at the first end 20 may further comprise one or more lever arms 84 pivotally connected to the structural frame 12 (FIGS. 2, 6 and 7).

Figure 3:
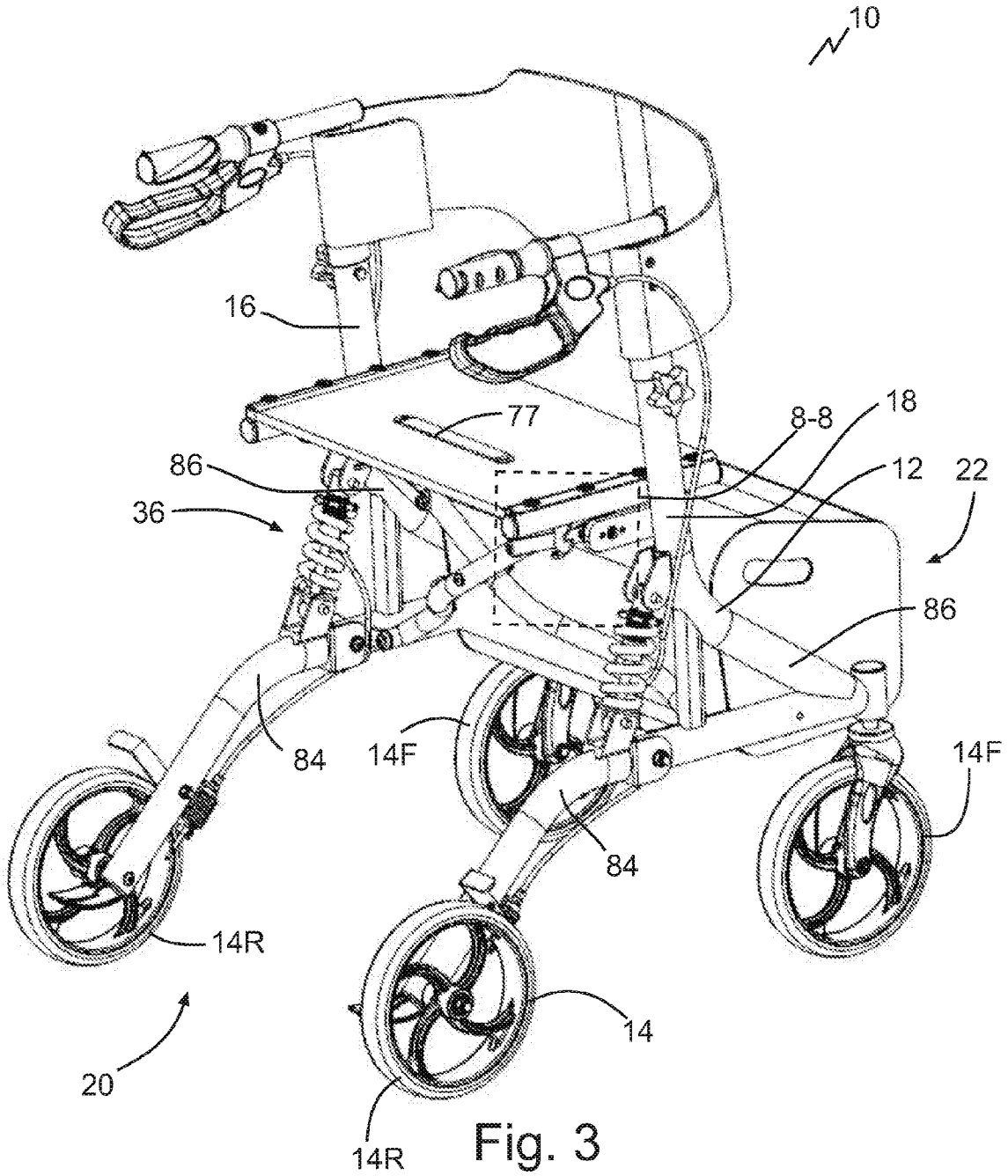

Struts 79 may be extended between the one or more lever arms 84 and the structural frame 12. In the example shown, upright portions 16 and 18 are pivotally connected to a respective lever arm 84 extending to a respective ground engaging element 14R at the first end 20 (FIG. 3). The first and second upright portions 16 and 18 may each have a respective fork 86, for example in the shape of a sideways A-frame as shown, that mounts a respective ground engaging element 14F at the second end 22 (FIGS. 2, 3, and 6). Each fork 86 may have a first branch 87 extended to a respective handle 28, 30, and a second branch 88 pivotally connecting a respective lever arm 84 (FIG. 2). Branches 87 and 88 may intersect at a meeting point 89 at or near second end 22 as shown. A gusset 90 may be spaced from meeting point 89 to span branches 87 and 88 to brace and increase the maximum vertical load tolerated by structural frame 12. Each strut 79 may pivotally connect to the respective upright portion 16 or 18 at a point on branch 87 or at a point on a handle bar mount portion 91. Handle bar mount portion 91 of each upright portion may telescopically connect to a respective handle, in this case handle 28, for height adjustment of the handles 28 or 30 (FIG. 2). A threaded bolt 136 may be provided for locking the handles 28, 30 at a particular height.

Referring to FIG. 2, struts 79 provide suspension at least for rear wheels 14R. In addition, struts 79 may cushion a user who is sitting down and assist the user in standing up from a sitting position upon seat 23. The latter advantage may be understood as follows. A user compresses struts 79 upon sitting upon seat 23. When the user goes to stand up, the potential energy stored in the compressed struts 79 is released to provide a vertical assist to the user leaving the seat 23. Each strut 79 may be adjustable in stiffness, for example using one or more insertable spacers 138 or another suitable mechanism to adjust the vertical assist in relation to the weight of a particular user. Allowing each strut 79 to be tailored in stiffness permits the walker 10 to be adjusted to suit a person who may lean to the left or right. Although only rear wheels 14R are shown to have suspension, in some cases all ground engaging elements 14 may have suspension, for example independent suspension. Struts 79 also reduce vibration during movement.

Referring to FIGS. 6 and 7, exploded views of an example arrangement of parts for mounting ground engaging elements 14R and 14F are shown. Wheel 14R may be mounted to lever arm 84, and wheel 14F may be mounted to respective upright portion 16, 18, using a partially threaded bolt 92, bearings 93, bushings 94, spacers 95, washers 96, and nuts 97. Wheels 14F or 14R may be side mounted, for example wheels 14R, or mounted in a U-bracket 114 through holes 140, for example with wheels 14F. Other wheel connections may be used.

Two or more wheels, for example wheels 14F, may be pivotally connected to structural frame 12 to permit steering of walker 10. For example, U-bracket 114 may mount for rotation to a respective upright portion, in this case portion 16, using a partially threaded bolt 116, bushings 117, bearings 118, and a nut 119, all mounted within a cylinder 120, which is connected to upright portion 16, and capped with a cap 121 over cylinder 120. A cane receiver 122 may be connected to frame 12.

A wheel lock tab 98 may be used to lock movement of one or more wheels 14R or 14F (FIG. 6). Tab 98 mounts on bolt 92 within a spacer ring 99, and is pivotally connected to a hub 100 that mounts bolt 92. When a user steps on tab 98, hub 100 frictionally locks bolt 92 and prevents wheel rotation. To release the wheel lock, the tab 98 is rotated upwards.

A U-bracket 102 and bolt 104 may be used to mount each strut 79 to lever arm 84 (FIG. 6). Similarly, each lever arm 84 may pivotally connect to a respective branch 88 with a U-bracket 106 and bolt 108. Each strut 79 may pivotally connect to structural frame 12 through a U-bracket 110 and bolt 112. Pivotal connections between parts may be made by other suitable connection mechanisms.

Referring to FIG. 1, brakes 124 may be provided on each handle 28, 30. Brakes may comprise a hand grip 126 pivotally connected to impart tension when gripped upon a wire rope (not shown) within a cable 130. Cable 130 extends to a lever 132 pivotally connected to lever arm 84, with the wire rope connecting to the lever 132 to rotate the lever 132 to bring a brake pad 134 on lever 132 in contact with wheel 14R during braking. Other brake systems may be used.

In the claims, the word "comprising" is used in its inclusive sense and does not exclude other elements being present. The indefinite articles "a" and "an" before a claim feature do not exclude more than one of the feature being present. Each one of the individual features described here may be used in one or more embodiments and is not, by virtue only of being described here, to be construed as essential to all embodiments as defined by the claims.

The embodiments of the invention in which an exclusive property or privilege is claimed are defined as follows:

1. A walker having a folded position and an unfolded position, the walker comprising:

a structural frame with a first upright portion, a second upright portion, a folding mechanism between the first upright portion and the second upright portion, and ground engaging elements on each of the first upright portion and second upright portion; and a foldable basket with first and second opposed ends secured by one or more fasteners to the first upright portion and the second upright portion, respectively, to prevent the foldable basket from being removed by the user during use, in which the one or more fasteners comprise fasteners that:

are threaded to a part and must be unthreaded from the part to disassemble the fastener to disconnect the foldable basket from the first upright portion and the second upright portion; or require a tool to disassemble the fastener to disconnect the foldable basket from the first upright portion and the second upright portion; or cannot be disassembled to disconnect the foldable basket from the first upright portion and the second upright portion without damaging the walker or the fastener.

2. The walker of claim 1 in which the one or more fasteners cannot be disassembled to disconnect the foldable basket from the first upright portion and the second upright portion without damaging the walker or the fastener.

3. The walker of claim 1 in which the one or more fasteners include rivets.

4. The walker of claim 1 in which the one or more fasteners include one or more of bonds, threaded fasteners, nails, Christmas tree fasteners, adhesive, straps, crimps, tape, stitches, staples, and rod and split pin combinations.

5. The walker of claim 1 in which the first and second opposed ends comprise plates.

6. The walker of claim 1 further comprising a suspension system integrated with the first upright portion and second upright portion.

7. The walker of claim 1 in which the first upright portion and the second upright portion fold towards and away from each other and define respective sides of the walker extending between a first end of the walker and a second end of the walker, and further comprising a handle or handles on the first upright portion and the second upright portion at the first end of the walker.

8. The walker of claim 2 in which the folding mechanism further comprises a pair of scissor beams, each scissor beam having an intermediate pivot region separating a first span and a second span, with the first span pivotally connected to one of the first upright portion or second upright portion, and the second span pivotally connected to the other of the first upright portion or second upright portion through a lever arm, in which each second span comprises a lock for engaging the respective lever arm to lock the walker in an unfolded position.

9. The walker of claim 8 in which each lock comprises a latch pivotally connected to the respective second span and having a slot positioned to engage a corresponding pin on the respective lever arm in the unfolded position.

10. The walker of claim 9 in which each pin defines a first travel path between a folded and an unfolded position, and in which each latch defines a second travel path that intersects the respective first travel path, each latch being biased into a closed position and having an outer profile shaped at a pin contact point on the second travel path to allow the pin to open the latch and enter the slot.

11. The walker of claim 10 further comprising a handle connected to open both latches when under one or more of tension or compression.

12. The walker of claim 1 in which the ground engaging elements comprise wheels.

13. A method of use of the walker of claim 1 further comprising folding and unfolding the walker.

14. A walker comprising:

a structural frame with a rear end, a front end, and sides between the rear end and the front end;

a handle or handles on the structural frame at the rear end of the structural frame;

rear ground engaging elements at the rear end of the structural frame;

front ground engaging elements at the front end of the structural frame;

a seat;

lever arms, with each lever arm pivotally connected to the structural frame at or near a respective side of the structural frame at a pivot point, in which at least when the walker is viewed from the side, a) each pivot point is below the seat, and b) each lever arm is extended in a rearward direction from the pivot point to mount a respective rear ground engaging element behind a rear end of the seat; and a suspension system integrated with the structural frame, the suspension system comprising elastic elements, with each elastic element connected between the structural frame and a respective one of the lever arms, and with the elastic elements being compressible to i) provide cushion and store energy when the weight of a user, sitting in the seat or leaning on the handle or handles, causes the pivot points to move in a downward direction, and ii) return the energy when unweighted by the user to cause the pivot point to move in an upward direction and provide a lift assist to the user.

15. The walker of claim 14 in which the seat is at the rear end of the structural frame.

16. The walker of claim 14 in which each element comprises a strut extended between the structural frame and the respective lever arm.

17. The walker of claim 16 in which the structural frame further comprises first and second upright portions that each define a respective side of the structural frame, extend to a respective handle, and are connected to a respective strut, and in which the structural frame further comprises a folding mechanism between the first and second upright portions to allow the first and second upright portions to fold towards and away from each other.

18. The walker of claim 17 in which the first and second upright portions each have a respective fork that mounts a respective front ground engaging element at the front end, have a first branch extended to the respective handle, and have a second branch pivotally connecting a respective lever arm.

19. The walker of claim 16 in which each strut is adjustable in stiffness.

20. A method of use of the walker of claim 14.

21. The walker of claim 18 in which, at least when the walker is viewed from the side, each second branch extends horizontally to the respective pivot point in use.

22. The walker of claim 14 in which, at least when the walker is viewed from the side, each pivot point is located midway between a respective rear ground engaging element and a respective front ground engaging element.

23. The walker of claim 22 in which, at least when the walker is viewed from the side, each pivot point is located midway between a front end of the seat and the rear end of the seat.

24. The walker of claim 14 in which the structural frame forms a rigid weight-bearing support between the front ground engaging elements and the handle or handles.

* * * * *